US008986521B2

(12) United States Patent
Dufresne

(10) Patent No.: US 8,986,521 B2
(45) **Date of Patent: *Mar. 24, 2015**

(54) CONTACT BAR FOR CAPPING BOARD

(75) Inventor: Robert P. Dufresne, St-Bruno (CA)

(73) Assignee: Pultrusion Technique Inc., St-Bruno (CA)

( * ) Notice: Subject to any disclaimer, the term of this patent is extended or adjusted under 35 U.S.C. 154(b) by 454 days.

This patent is subject to a terminal disclaimer.

(21) Appl. No.: 13/366,687

(22) Filed: Feb. 6, 2012

(65) Prior Publication Data

US 2013/0032474 A1 Feb. 7, 2013

Related U.S. Application Data

(63) Continuation of application No. 12/528,435, filed as application No. PCT/CA2008/000339 on Feb. 21, 2008, now Pat. No. 8,123,917.

(30) Foreign Application Priority Data

Feb. 22, 2007 (CA) ..... 2579459

(51) Int. Cl.

| | |
|---|---|
| ***B23H 7/26*** | (2006.01) |
| ***B23H 11/00*** | (2006.01) |
| ***C25B 9/00*** | (2006.01) |

(Continued)

(52) U.S. Cl.

CPC .... *C25C 7/00* (2013.01); *C25C 7/02* (2013.01)
USPC ..... 204/297.01; 204/297.06; 204/286.1

(58) Field of Classification Search

CPC ..... C25C 7/00; C25C 7/02; C25B 9/00; C25B 9/02; C25B 9/04; C25B 9/06; C25B 9/18
USPC ..... 204/279, 297.01, 297.06, 280, 286.1
See application file for complete search history.

(56) References Cited

U.S. PATENT DOCUMENTS

| | | | |
|---|---|---|---|
| 3,697,404 | A | 10/1972 | Paige |
| 4,035,280 | A | 7/1977 | Deane et al. |

(Continued)

FOREIGN PATENT DOCUMENTS

| | | |
|---|---|---|
| CA | 1201681 | 3/1986 |
| CA | 2171412 | 9/1997 |
| CA | 2451950 | 6/2005 |

OTHER PUBLICATIONS

Wiechmann et al. (Canadian Metallurgical Quarterly, vol. 41, No. 4, pp. 425-432, 2002).*

*Primary Examiner* — Luan Van
*Assistant Examiner* — Alexander W Keeling
(74) *Attorney, Agent, or Firm* — Baker Hostetler LLP

(57) ABSTRACT

Disclosed is a segmented contact bar for use boarding an electrolytic cell. The segmented contact bar has contact pieces made of electrically conductive material and being in spaced apart relation along the capping board, each of the contact pieces defining a segment for supporting and electrically connecting an anode and a cathode in the electrolytic cell. The segmented contact bar also has connection members including an insulating material and provided in between pairs of adjacent segments for providing insulating interconnection of the segments. There is also an electrolytic refining apparatus including adjacent electrolytic cells; a capping board positioned on the adjacent electrolytic cells; anodes and cathodes extending in spaced apart alternate positions into the each of the adjacent electrolytic cells along the capping boards; and a segmented contact bar.

38 Claims, 5 Drawing Sheets

(51) Int. Cl.

| | |
|---|---|
| ***C25C 7/00*** | (2006.01) |
| ***C25D 17/00*** | (2006.01) |
| ***C25C 7/02*** | (2006.01) |

(56) References Cited

U.S. PATENT DOCUMENTS

| | | | | |
|---|---|---|---|---|
| 4,213,842 | A | 7/1980 | Dufresne | |
| 5,645,701 | A | 7/1997 | Dufresne et al. | |
| 6,342,136 | B1 | 1/2002 | Virtanen et al. | |
| 7,204,919 | B2 | 4/2007 | Dufresne | |
| 7,223,324 | B2 | 5/2007 | Dufresne | |
| 7,597,786 | B2 | 10/2009 | Kivisto et al. | |
| 7,854,825 | B2 | 12/2010 | Ebert | |
| 8,123,917 | B2 * | 2/2012 | Dufresne | 204/297.01 |
| 2005/0121319 | A1 | 6/2005 | Dufresne | |

* cited by examiner

CONTACT BAR FOR CAPPING BOARD

CROSS-REFERENCE TO RELATED APPLICATIONS

This application is a Continuation of U.S. patent application Ser. No. 12/528,435, filed on Oct. 28, 2009, which is a National Stage Entry of International Patent Application No. PCT/CA2008/000339, filed on Feb. 21, 2008, which claims priority to foreign Patent Application CA 2,579,459, filed on Feb. 22, 2007, the disclosures of which are incorporated herein by reference in their entirety.

FIELD OF THE INVENTION

The present invention relates to a contact bar for use on a capping board, also called "bus bar insulator", of a given length in order to electrically connect a plurality of anodes and cathodes extending in spaced apart alternate positions in adjacent electrolytic cells all along the capping board.

BACKGROUND OF THE INVENTION

In the hydrometallurgical industry, it is of common practice to refine metal by electrolysis in electrolytic cells especially designed for this purpose. The metals to be refined are usually conventional metals like copper, zinc, nickel or cadmium, or precious metals like silver, platinum or gold, and others.

It is also of common practice to use metal plates as anodes or cathodes or both. These metal plates weight several hundred pounds. Usually, the metal to be refined, or the metal used to carry the electric current, is in the form of plates of a given thickness, which are provided at their upper end with two laterally extending projections. Such projections facilitate gripping, handling and hanging of the plates on lateral sidewalls of the cells. These projections serve also to electrically contact or insulate the electrode.

In use, the plates which, as aforesaid, can each weight several hundred pounds, are immersed into the cells in parallel relationship and are used as anodes, cathodes or both, depending on the affinity of the metal being refined.

In order to have the electrodes positioned at the exact place, it is of common practice to place a member called "capping board" or "bus bar insulator" onto the top surface of each lateral sidewall of the cells. These capping boards are used to position the plates with respect to each other. They are also used as electric insulators between adjacent cells and/or each electrodes and/or the ground.

In practice, the capping boards are used not only as supports to position the electrodes, but also as supports to avoid damage to the masonry or concrete forming the lateral side walls of the cells during the insertion and removal of the heaving electrodes.

As aforesaid, the above mentioned insulating capping boards are used to hold the electrodes at very precise positions. They are also used in combination with electrically conductive contact bars whose purpose is to allow electrical connection between the ends of the anodes and cathodes located in the adjacent cells. Thus, the combined use of capping boards and contact bars have the particularity of allowing insulation and distribution of electric current at the same time.

To achieve proper electrical contact with the contact bar, the plates forming the electrodes are provided with support hanging legs externally projecting on their opposite upper ends. Only one end of the legs of each plate is in contact with a contact bar on one side of the cell where it is located. The other leg of the same plate is held onto the capping board located on the opposite side of the cell in such a way as to be insulated. Thus, the capping board per se plays the role of an insulator and has, for this purpose, to be made of material that is insulating.

So far, it has been of common practice to use contact bars of usually triangular cross-section, that extends over the full length of the corresponding capping board in order to connect altogether all the anodes of one cell to all the cathodes of the adjacent cell.

The problem with such contact bars is that, in the case that a short circuit would occur, such would "affect" all the electrodes which are connected altogether. Such causes the temperature of some of the metal plates forming the anodes and cathodes and the contact bar to increase and such an increase may be transmitted to the insulating capping-boards, which may then be subject to deformation. Such deformation is unacceptable since it may generate other short circuits that may propagate from one cell to another cell and which may result in the production of a refined metal with major impurity and defects.

SUMMARY OF THE INVENTION

It has now been discovered that the above mentioned problem encountered with the conventional contact bars in the case of short circuits, may be solved if the contact bars are "divided" into a plurality of segments on which only a short number of the anodes and cathodes are connected.

Due to such a division of the contact bars into segments, any short circuit that occurs by accident is using only the electric current of the segment instead of the electric current of the whole cell. It is actually transmitted only to the few electrodes in contact with the segment(s) to which is connected the electrode that is at the origin of the trouble.

Thus, embodiments of the invention are directed to an improved contact bar for use on a capping board of a given length in order to electrically connect a plurality of anodes and cathodes extending in spaced apart alternate positions in adjacent electrolytic cells all along said capping board or bus bar insulator, the contact bar extending over the length of the capping board and being of a given average cross-section.

In one embodiment, a segmented contact bar comprises:

- a plurality of contact pieces made of an electrically conductive material and being in spaced apart relation along the capping board, each of the contact pieces defining a segment for supporting and electrically connecting an anode and a cathode in the electrolytic cell; and
- connection members comprising an insulating material and provided in between pairs of adjacent segments for providing insulating interconnection of the segments.

Due to such a division of the contact bar into segments formed by the contact pieces that are no more an electrical contact with each other thanks to the core made of insulating material, any short circuit that occurs by accident is no more "transferred" to all the electrodes of the cells. It is actually transmitted only to the few electrodes in contact with the segment(s) to which is connected the electrode that may cause the trouble.

The core may consist of a pultruded rod obtained by pultrusion of fibers.

The core may also comprise a metal rod that is completely embedded therein and extends all over the length of the pultruded core.

In practice, each segment of the improved contact bar according to embodiments of the invention may be sized to allow connection of only two anodes located in one of the adjacent cells to only two cathodes located in another one of the adjacent cells. Alternatively, each segment may be sized to allow connection of three, four or more adjacent anodes located in one of the adjacent cells to three, four or more adjacent cathodes located in another one of adjacent cells.

Advantageously, all the electrodes of one cell may not be in direct contact with no gap or resistance in between, with all the electrodes of the adjacent cell.

DETAILED DESCRIPTION

Figure 1:
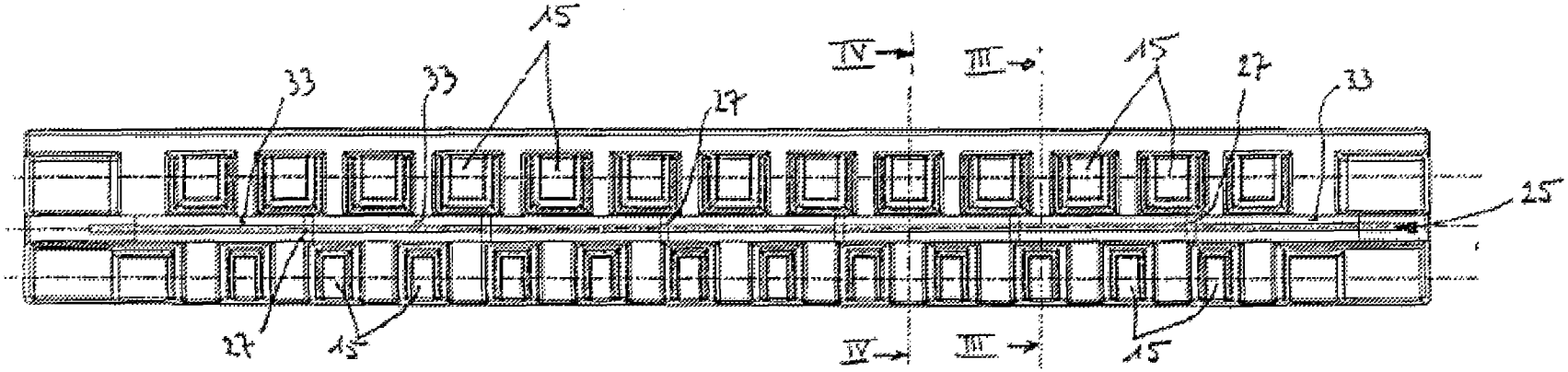
FIG. 1 is a top plan view of one of the capping boards disclosed the above mentioned U.S. patent application filed on Dec. 3, 2003, which capping board is provided with a central path in which a contact bar according to an embodiment of the invention is positioned.
Figure 2:
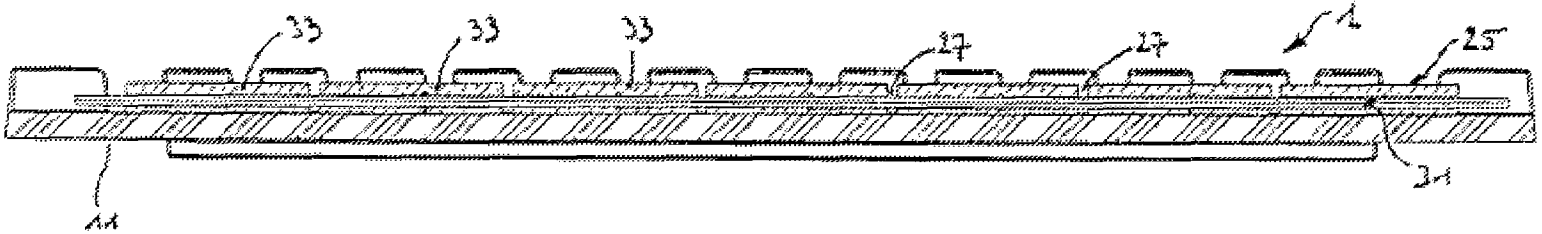
FIG. 2 is a side elevational cross-section view taken along lines II-II of the capping board and contact bar shown in FIG. 1.

The invention will now be described with reference to the drawing figures, in which like reference numerals refer to like parts throughout.

Figure 4:
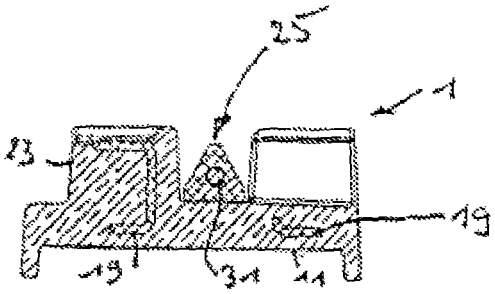
Figure 5:
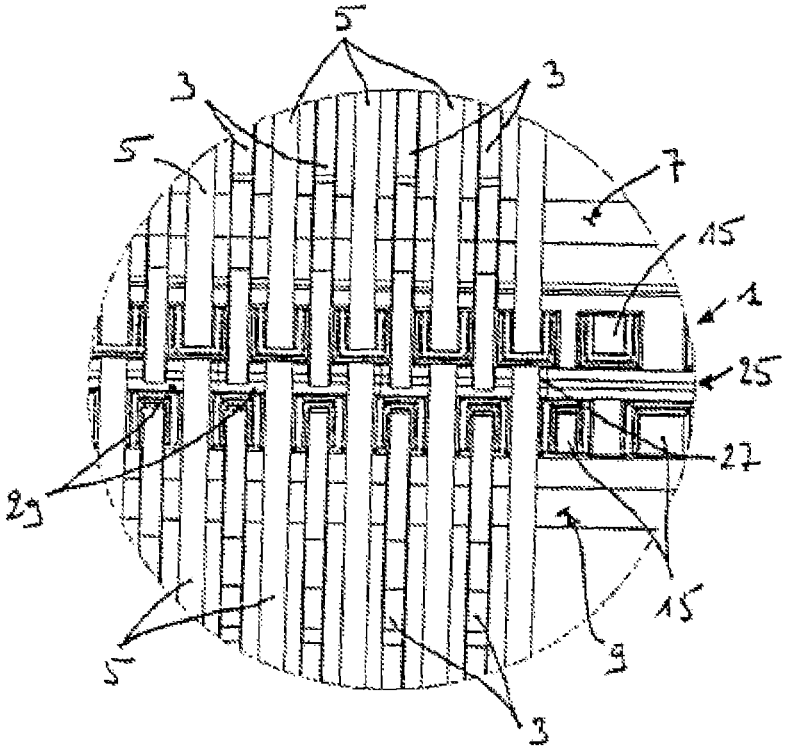
FIG. 5 is a top plan view of a portion of the capping board and contact bar shown in FIGS. 1 to 4, illustrating the way they support the ends of the anodes and cathodes located in adjacent electrolytic cells.
Figure 6:
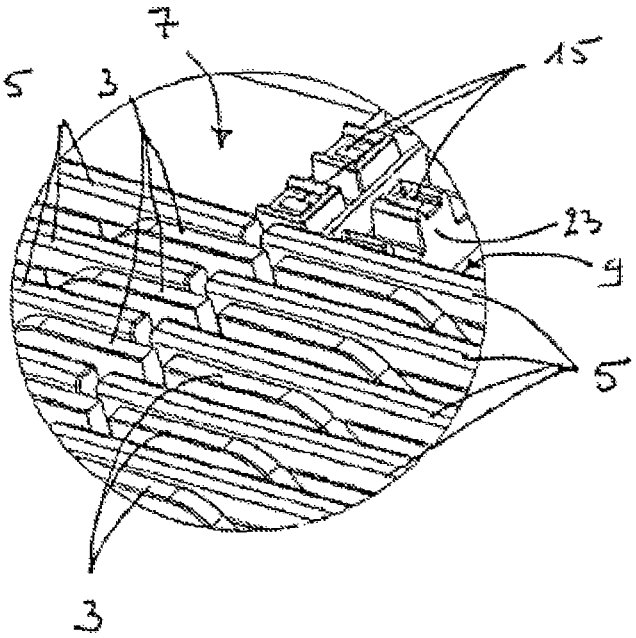
FIG. 6 is a perspective view of the capping board, contact bar and electrodes shown in FIG. 5.
Figure 7:
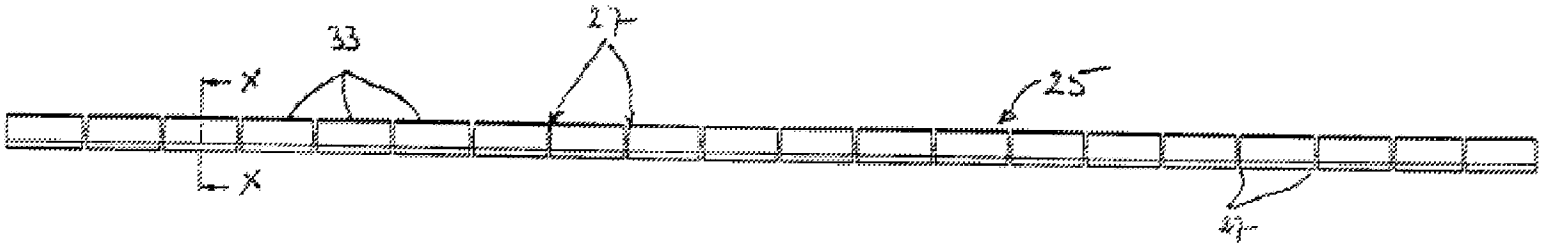
FIG. 7 is a side elevational view of the contact bar according to the first embodiment of the invention, as shown in the previous Figures.
Figure 8:
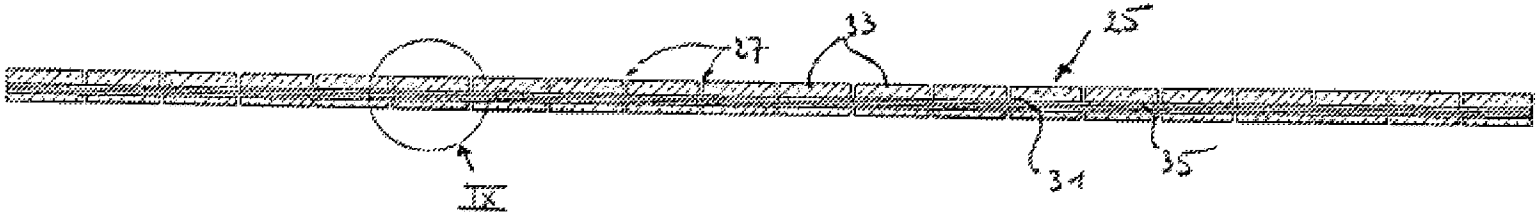
FIG. 8 is a cross-sectional view of the contact bar shown in FIG. 7.
Figure 9:
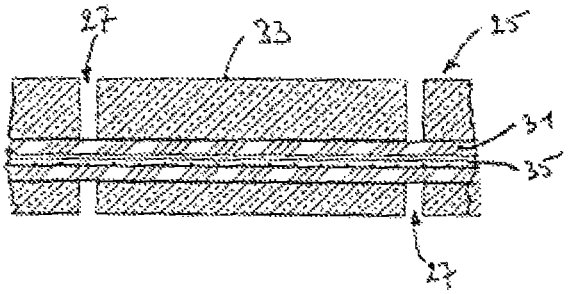
FIG. 9 is an enlarged cross-sectional view of part IX of the contact bar shown in FIG. 8.

This capping board 1 is intended to be used to support the hanging legs of anodes 3 and cathodes 5 mounted within adjacent electrolytic cells 7 and 9 (see FIGS. 5 and 6). It basically comprises a main body with a bottom surface 11 shaped to fit onto upper edges of two adjacent cells. It also comprises a top surface in which individual seats 15 are made. As is better shown in FIGS. 3, 4 and 6, the seats 15 are in the form of recesses made on top of spaced-part blocks 23 integral to and upwardly projecting from the top surface of the main body, each of the recesses forming a laterally opening compartment.

More specifically, the capping board 1 comprises a first set of spaced apart blocks 23 extending in line all over its length on one side of the main body, and a second set of spaced apart blocks 23 extending also in line all over its length at a given lateral distance from the first set of blocks. The two sets of blocks 23 form two rows that together define a central part in which a contact bar 25 may be positioned.

As is shown the blocks 23 of the first set are in alternate position relative to those of the second one, whereby an anode 3 or cathode 5 having one hanging leg held within a recess made on top of one of the blocks on one side of a cell may have its opposite hanging leg that extends between two adjacent blocks of another capping board located on the other side of the cell and thus bears onto the contact bar 25 located in the central path of the other capping board.

Figure 3:
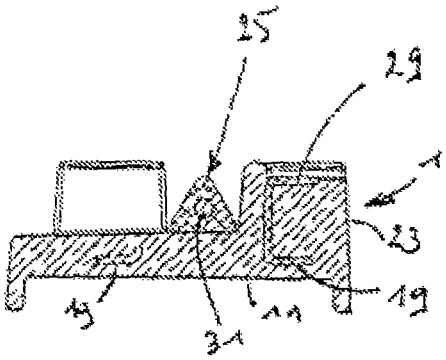
FIGS. 3 and 4 are cross-sectional views taken along lines III-III and IV-IV of the capping board and contact bar shown in FIG. 1.

As shown in FIGS. 3 and 4, two sheets 19 of conductive material, preferably made of copper, are embedded into the main body of the capping board. Each sheet 19 has a base from which integrally project a plurality of L-shaped teeth 29. Each of the teeth 29 extend into one of the blocks 23 in such a manner as to have part of it that extends externally into the recess 15 forming the compartment on top of the insulating block.

The capping boards 1 is preferably made from a plastic resin selected from the group consisting of polytetrafluoroethylene, acid resistant polyester, polyvinyl ester, epoxy, polyurethane, thermoset urethane, bisphenol-epoxy A-F fumarate polyester, acrylic and methacrylic terephtalate polyester and phenolic resins, and blends of such resins, to which from 3 to 30% of glass fibres, from 2 to 10% of silica sand, from 1 to 30% mica, and from 2 to 40% of silica rock in the form of particles, have been added. Use can also be optionally made of 2 to 40% filler such as clay, talc, calcium carbonate and magnesium oxide and from 0.1 to 5% of fumed silica.

In practice, use is preferably made of an acid-resistant polyester resin because this resin is less expensive in addition of being easy to handle and providing good material stability.

Advantageously, the capping board 1 may also comprise at least one embedded pultruded bar. Each of those pultruded bars may be obtained by pultrusion of fibres selected from the group consisting of glass fibres, cizal fibres or resin fibres with a resin selected from the group consisting of polyester, vinyl ester, epoxy, polyurethane, thermoset urethane, bisphenol-epoxy A-F fumarate polyester series, acrylic and methacrylic, terephatalate polyester, urethanes and phenolic resins and their mixtures, said at least one pultruded bar being further coated with a surface layer of a resin bonding agent.

Preferably, more than one pultruded bars are embedded into the capping board, their bars being spaced-apart and arranged in a parallel relationship over the full length of the capping board.

As aforesaid, the present invention lies in the structure of the contact bar 25 that is used in combination with the above capping board 1. In this connection, it may be understood the contact bar 25 according to the invention could also be used with other conventional capping boards, like those disclosed in the various patents mentioned hereinabove.

In accordance with the invention, the contact bar 25 extends all over the length of the capping board 1 for the purpose of allowing connection of the anodes 3 located in one electrolysis cell to the cathodes 5 located in the adjacent electrolysis cell, via their respective hanging legs that stay directly on it.

As better shown in FIGS. 7 to 12, the contact bar 25 is preferably of triangular cross-section. However, it could be of a different cross-section.

The contact bar 25 according to the invention distinguishes from the contact bars presently in use in the industry, in that it comprises a central core 31 that is made of an insulating material and extends all over its length. It also comprises a plurality of contact pieces 33 that are made of an electrically conductive material and are positioned in spaced apart positions all along the core 31, each of the pieces 33 defining one segment on which only a short number of the anodes and cathodes are connected. The segments defined by the pieces 33 are separated from each other by grooves 27 that extend down to the core 31.

Figure 10:
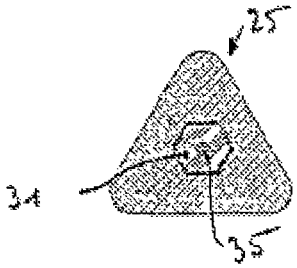
FIG. 10 is a cross-sectional view taken along lines X-X, the contact bar shown in FIG. 7.
Figure 11:
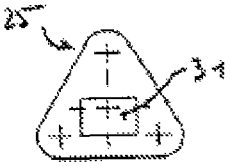
FIG. 11 is a cross-sectional view similar to FIG. 10, but illustrating a core of a different structure.
Figure 12:
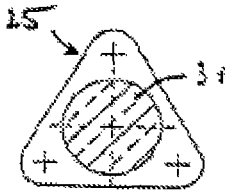
FIG. 12 is a cross-sectional view similar to FIG. 10 but illustrating a core of another different structure.

In practice, the core 31 may be of circular cross-section as shown in FIG. 12. However, it could be of non-circular cross-section, like square, or rectangular as shown in FIG. 11, hexagonal as shown in FIG. 10, and the like.

Preferably, the core 31 consists of a pultruded bar like those used to reinforce the above mentioned capping board 1, which bar is obtained by pultrusion of fibers.

Preferably also, the core 31 may comprise a metal rod 35 completely embedded therein, this metal rod extending all over the length of the core. (see FIGS. 8 to 10). Such a metal rod 35 prevents the contact bar 25 from breaking or being cut.

As may be seen in the accompanying drawings (see in particular FIGS. 5 and 6), each of the contact pieces 33 is sized to allow connection of only two anodes 3 located in one of the adjacent cell to only two cathodes 5 located in the other adjacent cell. As aforesaid, due to such a division of the contact bar 25 into segments, any short circuit that occurs by accident is no more "transferred" to all the electrodes of the cells. It is actually transmitted only to the electrode in contact with the segment to which is connected the electrode that is at the origin of the trouble. Such not only reduces but avoids the risk of transmission of a short circuit to all electrodes, as it may occur with the existing contact bars.

Even though such has not been illustrated, each contact piece 33 could be sized to allow connection of two, three, four or more adjacent anodes located in one of the adjacent cells, to two, three, four or more adjacent cathodes located in another one of adjacent cells, instead of connecting only one of them only to each other. In all cases, the only requirement is that all the electrodes of one cell be not in direct contact with no gap or resistance in between, with all the electrodes of the adjacent cell.

Of course, other modification could be made to the contact bar disclosed hereinabove without departing from the scope of the invention as broadly disclosed in the summary of the invention and the appended claims.

What is claimed is:

1. A segmented contact bar for use in an electrolytic cell, the segmented contact bar comprising:

a plurality of contact pieces made of an electrically conductive material and being in spaced apart relation along a capping board, each of the contact pieces defining a segment for supporting and electrically connecting an anode and a cathode in the electrolytic cell; and connection members comprising an insulating material and provided in between pairs of adjacent segments for providing insulating interconnection of the segments.

2. The segmented contact bar of claim 1, wherein the connection members are a single core extending through the segments.

3. The segmented contact bar of claim 2, wherein the core consists of the insulating material.

4. The segmented contact bar of claim 2, wherein each segment completely surrounds a corresponding portion of the core.

5. The segmented contact bar of claim 2, wherein the core comprises a central support member and an outer part made of the insulating material.

6. The segmented contact bar of claim 5, wherein the central support member comprises a metal rod.

7. The segmented contact bar of claim 5, wherein the central support member is completely embedded in the insulating material.

8. The segmented contact bar of claim 5, wherein the central support member extends the entire length of the core.

9. The segmented contact bar of claim 2, wherein the core has an outer surface having a circular cross-section.

10. The segmented contact bar of claim 2, wherein the core has an outer surface having a non-circular cross-section.

11. The segmented contact bar of claim 2, wherein the core has an outer surface having an octagonal, a square or a rectangular cross-section.

12. The segmented contact bar of claim 1, wherein each of the connection members has a central support member and an outer part made of the insulating material.

13. The segmented contact bar of claim 12, wherein the central support member comprises a metal rod.

14. The segmented contact bar of claim 12, wherein the central support member is completely embedded in the insulating material.

15. The segmented contact bar of claim 1, wherein the connection members consist of the insulating material.

16. The segmented contact bar of claim 1, wherein the insulating material is pultruded.

17. The segmented contact bar of claim 1, wherein the insulating material comprises pultruded fibers.

18. The segmented contact bar of claim 1, wherein each segment has an outer surface having a triangular cross-section.

19. The segmented contact bar of claim 18, wherein the triangular cross-section of each segment has beveled corners.

20. The segmented contact bar of claim 18, wherein the connection members are equidistant from each side and each corner of the triangular cross-section.

21. The segmented contact bar of claim 1, wherein each segment is sized to allow connection of at least two adjacent anodes located in one of a pair of adjacent electrolytic cells to at least two adjacent cathodes located in another one of the adjacent cells.

22. The segmented contact bar of claim 1, wherein each segment is sized to allow connection of two adjacent anodes located in one of a pair of adjacent electrolytic cells to two adjacent cathodes located in another one of the adjacent cells.

23. The segmented contact bar of claim 1, wherein each of the segments is sized to allow connection of three adjacent anodes located in one of a pair of adjacent cells to three adjacent cathodes located in another one of the adjacent cells.

24. The segmented contact bar of claim 1, wherein each of the segments is sized to allow connection of four adjacent anodes located in one of a pair of adjacent cells to four adjacent cathodes located in another one of the adjacent cells.

25. The segmented contact bar of claim 1, wherein the segments are of equal size and length.

26. The segmented contact bar of claim 1, wherein the insulating material is composed of pultruded material obtained by pultrusion of fibres selected from the group consisting of glass fibres, cizal fibres or resin fibres with a resin selected from the group consisting of polyester, vinyl ester, epoxy, polyurethane, thermoset urethane, bisphenol-epoxy A-F fumarate polyester series, acrylic and methacrylic, terephatalate polyester, urethanes and phenolic resins and mixtures thereof.

27. The segmented bar of claim 26, wherein the pultruded material is further coated with a surface layer of a bonding agent.

28. An electrolytic refining apparatus comprising:

adjacent electrolytic cells;

a capping board positioned on the adjacent electrolytic cells;

anodes and cathodes extending in spaced apart alternate positions into the each of the adjacent electrolytic cells along the capping board; and a contact bar positioned on the capping board in order to support and electrically connect the anodes and the cathodes, the contact bar comprising:

a plurality of contact pieces made of an electrically conductive material and being in spaced apart relation along the capping board, each of the contact pieces defining a segment for supporting and electrically connecting an anode and a cathode; and connection members comprising an insulating material and provided in between pairs of adjacent segments for providing insulating interconnection of segments.

29. The electrolytic refining apparatus of claim 28, wherein the connection members are a single core extending through the segments.

30. The electrolytic refining apparatus of claim 28, wherein the anodes and the cathodes have hanging legs supported on the capping board and the contact bar.

31. The electrolytic refining apparatus of claim 28, wherein the capping board comprises a main body with a bottom surface shaped to fit onto upper edges of the adjacent electrolytic cells.

32. The electrolytic refining apparatus of claim 28, wherein the capping board comprises a top surface in which individual seats are provided.

33. The electrolytic refining apparatus of claim 32, wherein the seats are in the form of recesses made on top of spaced apart blocks integral to and upwardly projecting from a top surface of the main body, each of the recesses forming a laterally opening compartment.

34. The electrolytic refining apparatus of claim 33, wherein the capping board comprises a first set of the spaced apart blocks extending in line over its entire length on one side of the main body, and a second set of the spaced apart blocks extending also in line all over the entire length at a given lateral distance from the first set of blocks, the first and second sets of blocks forming two rows that together define a central part in which the contact bar is positioned.

35. The electrolytic refining apparatus of claim 34, wherein the blocks or the first set are in alternate position relative to the blocks of the second set and one of the anodes or one of the cathodes having a first hanging leg held within a recess made on top of one of the blocks on one side of a cell may have a second opposite hanging leg extending between two adjacent blocks of another capping board located on the other side of the electrolytic cell and thus bears onto the contact bar located in the central path of the other capping board.

36. The electrolytic refining apparatus of claim 28, wherein the capping board comprises sheets of conductive material embedded into the main body of the capping board.

37. The electrolytic refining apparatus of claim 28, wherein the capping board comprises a plastic resin selected from the group consisting of polytetrafluoroethylene, acid resistant polyester, polyvinyl ester, epoxy, polyurethane, thermoset urethane, bisphenol-epoxy A-F fumarate polyester, acrylic and methacrylic terephtalate polyester and phenolic resins, and blends of such resins.

38. The electrolytic refining apparatus of claim 37, wherein the capping board comprises an additive selected from the group consisting of from 3 to 30% of glass fibres, from 2 to 10% of silica sand, from 1 to 30% mica, from 2 to 40% of silica rock in the form of particles, from 2 to 40% clay, talc, calcium carbonate or magnesium oxide filler, from 0.1 to 5% of fumed silica, and at least one embedded pultruded bar obtained by pultrusion of fibres.

* * * * *